US005533636A

United States Patent [19]

Reiker

[11] Patent Number: 5,533,636

[45] Date of Patent: Jul. 9, 1996

[54] REVERSIBLE ESCUTCHEON

[76] Inventor: Kenneth H. Reiker, 269 Country Club Dr., Shalimar, Fla. 32579

[21] Appl. No.: 413,214

[22] Filed: Mar. 28, 1995

[51] Int. Cl.[6] ..... B65D 6/28

[52] U.S. Cl. ..... 220/3.8; 248/343; 174/66

[58] Field of Search ..... 220/241, 3.8, 242; 416/5; 169/37; 285/46; 174/66; 248/200.1, 57, 343

[56] References Cited

U.S. PATENT DOCUMENTS

| | | |
|---|---|---|
| Re. 33,147 | 1/1990 | Reiker . |
| D. 36,502 | 8/1903 | Watkins . |
| D. 47,273 | 4/1915 | Mohrmann . |
| D. 69,123 | 12/1925 | Frerichs . |
| D. 234,797 | 4/1975 | De John . |
| D. 288,289 | 2/1987 | Reiker . |
| 4,366,866 | 1/1983 | Sweeney . |
| 4,463,923 | 8/1984 | Reiker . |
| 4,518,314 | 5/1985 | Schultz . |
| 4,626,970 | 12/1986 | Huang . |
| 4,684,092 | 8/1987 | Reiker . |
| 4,780,573 | 10/1988 | Own . |
| 4,800,239 | 1/1989 | Hill . |
| 5,151,011 | 9/1992 | Rezek . |
| 5,183,233 | 2/1993 | LaPalomento . |
| 5,292,228 | 3/1994 | Dye . |

*Primary Examiner*—Joseph M. Moy
*Attorney, Agent, or Firm*—Shlesinger, Arkwright & Garvey

[57] ABSTRACT

A reversible escutcheon for a ceiling fixture having a base with first and second opposed surfaces. The base also defines a hole extending from the first surface to the second surface. A first raised edge extends around at least a portion of the perimeter of the base and projects from the first surface. A second raised edge extends around at least a portion of the perimeter of the base and projects from the second surface. The first and second edges are selectively mountable adjacent to a ceiling wherein one of the second and first surfaces is exposed, respectively.

15 Claims, 3 Drawing Sheets

REVERSIBLE ESCUTCHEON

FIELD OF THE INVENTION

The present invention relates generally to an escutcheon. In particular, the invention is directed to a reversible decorative escutcheon for a ceiling fixture.

BACKGROUND OF THE INVENTION

Escutcheons provide a decorative surface to cover a portion of a wall or to cover the opening in a ceiling through which the support of a ceiling fixture extends. Escutcheons are used to avoid an unpleasant and disagreeable appearance and to maintain the architectural appearance of the building interior by hiding the interface between the ceiling fixture support and the ceiling. Installation of fixtures is speeded up, as escutcheons cover up imprecise holes, irregular holes, and broken out portions of ceilings, for example.

Conventional escutcheons are known to come in a variety of shapes and designs, and are used with a variety of ceiling fixtures, such as ceiling fans, sprinklers, chandeliers, and other types of hanging lights. Because escutcheons are used in a variety of ceiling fixtures, manufacturers and retailers must make available a large variety of shapes and designs in order to meet consumer needs.

However, companies today are now focusing more and more on becoming more efficient, productive and profitable. Therefore, the need to reduce manufacturing and retail cost and to increase sales is a high priority.

OBJECTS AND SUMMARY OF THE INVENTION

It is therefore an object of the present invention to provide a reversible escutcheon which will reduce manufacturing and retail cost.

It is a further object of the invention to provide a reversible escutcheon which can be applied to any flat surface.

It is another object of the present invention to provide a reversible escutcheon which can be readily and securely installed during the installation of a ceiling fixture.

It is another object of the present invention to provide a reversible escutcheon configured with different types of indicia.

It is yet another object of the present invention to provide a reversible escutcheon which can be easily repainted to match the color of an existing ceiling.

It is still another object of the present invention to provide a reversible escutcheon which can be readily and inexpensively manufactured.

It is yet another object of the present invention to provide a reversible escutcheon which can be installed to cover a ceiling fixture hole without replastering the ceiling.

It is an object of the present invention to provide a reversible escutcheon which mounts flush with the ceiling without any modifications to the ceiling.

It is another object of the invention to provide a reversible escutcheon which will reduce inventory costs by at least half; e.g. by effectively providing two escutcheons in one.

It is a still further object of the invention to provide a multipurpose escutcheon engineered as a single component.

It is a further object of the invention to provide a reversible escutcheon which can be secured to a flat surface without the use of fasteners and tools.

In summary, the present invention is directed to a reversible escutcheon for a ceiling fixture which mounts flush with the ceiling.

BRIEF DESCRIPTIONS OF THE DRAWINGS

These and other objects, advantages and novel features of the present invention will become apparent from the following detailed description taken in consideration of the accompanying drawings, in which.

FIGS. 9A–9B, 10A–10B, and 11A–11B are further preferred embodiments of escutcheons according to the invention, respectively, showing respective paired front and rear sides.

DETAILED DESCRIPTION OF THE INVENTION

In the accompanying drawings, FIGS. 1–4 disclose a preferred embodiment of a reversible escutcheon A of the present invention.

Figure 1:
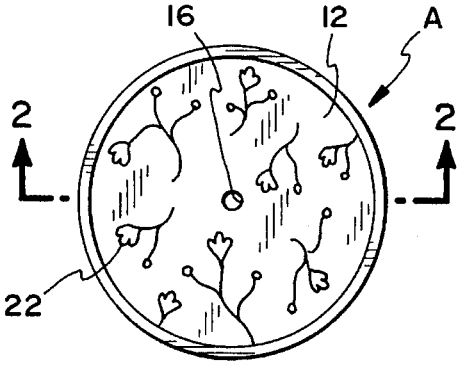
FIG. 1 is a plan view of an escutcheon according to the present invention.
Figure 2:
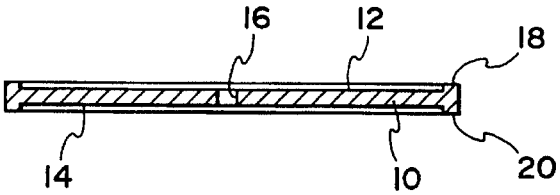
FIG. 2 is a sectional view taken along line 2—2 of FIG. 1.

Referring now to FIGS. 1 and 2, escutcheon A includes a base 10 having two opposing surfaces or escutcheon faces 12 and 14. A hole 16 extends from surface 12 toward surface 14, through base 10. Hole 16 is for receiving a support portion S of a ceiling fixture F (See FIG. 4) and can be configured to accommodate a variety of support shapes and sizes.

Escutcheon A further includes a raised edge 18 which extends around the perimeter of base 10 and projects from surface 12. Escutcheon A also includes a raised edge 20 which extends around the perimeter of base 10 and projects from surface 14.

It is further contemplated that one or both of raised edges 18 and 20 extend around only a portion of the perimeter of base 10.

Figure 3:
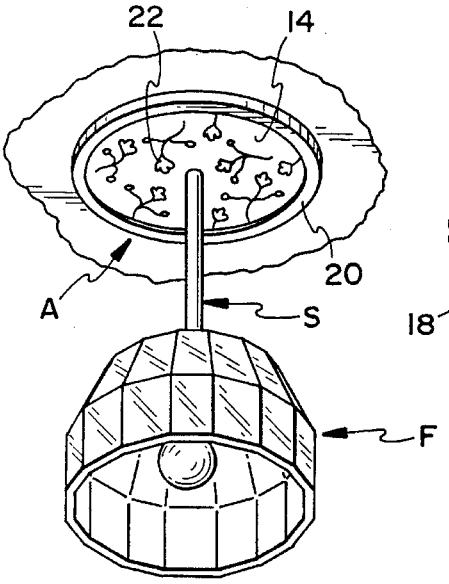
FIG. 3 is a perspective view of an escutcheon shown installed with a ceiling light fixture.

As shown in FIGS. 1 and 3, surfaces or escutcheon faces 12 and 14 are provided with patterns or indicia 22 which may be decorations. While the indicia 22 are shown to be print designs, it is contemplated to be within the scope of the invention that a variety of types of indicia 22 can be used. For example, surfaces 12 and 14 can be provided with raised and/or embossed patterns or designs (see FIG. 8), wood grain patterns, or even just a solid color.

It is also contemplated to be within the scope of the invention that surfaces 12 and 14 could each be provided with a different type of indicia, such as an embossed design on one surface and a wood grain design on the other surface.

Figure 4:
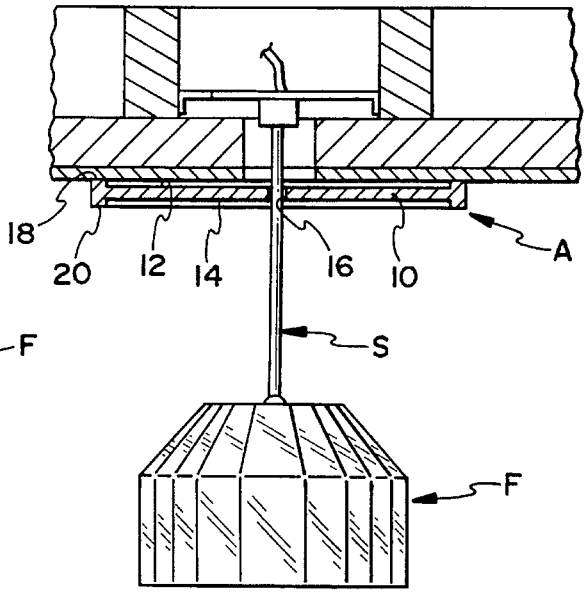
FIG. 4 is an elevational view similar to FIG. 3, with a partial sectional view of the escutcheon and a ceiling.

As shown in FIGS. 2, and 4, raised edges 18 and 20 are preferably greater in height than respective surfaces 12 and 14. This permits escutcheon A to be installed with either edge 18 or 20 substantially flush with the ceiling, allowing either surface 14 or 12 to be exposed, respectively, thereby making escutcheon A reversible without any additional modifications to the ceiling (See FIG. 4).

Figure 5:
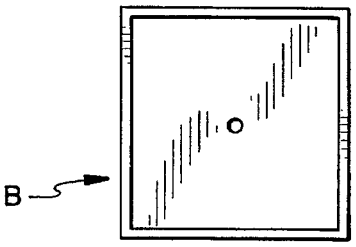
FIG. 5 is a plan view of another preferred embodiment of an escutcheon having a rectangular shape.
Figure 6:
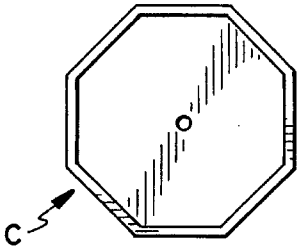
FIG. 6 is a plan view of still another preferred embodiment of an escutcheon having an octagonal shape.
Figure 7:
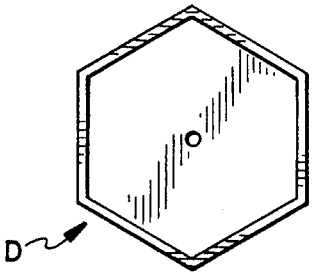
FIG. 7 is a plan view of yet another preferred embodiment of an escutcheon having a hexagonal shape.

FIGS. 5–7 illustrate other preferred embodiments of escutcheon A.

FIG. 5 shows an escutcheon B as having a generally rectangular shape.

FIG. 6 shows an escutcheon C as having a generally octagonal shape.

FIG. 7 shows an escutcheon D as having a hexagonal shape.

Figure 8:
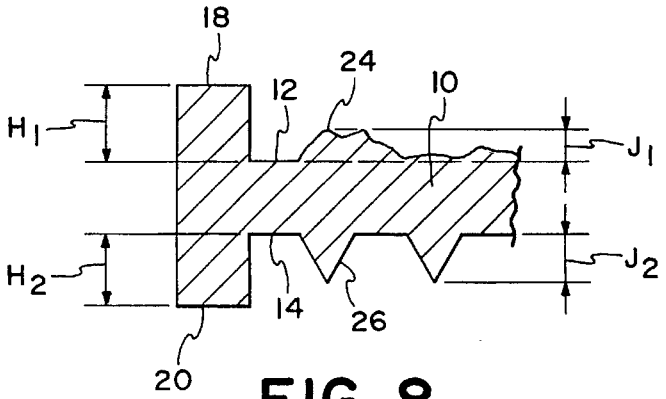
FIG. 8 is a partial sectional view illustrating embossed patterns on both sides of an escutcheon.

As further shown in FIG. 8, escutcheon A can be provided with embossed or raised patterns or indicia 24 and 26 on surfaces 12 and 14, respectively. To permit the flush installation of escutcheon A, it is preferred that the height H1 of raised edge 18 be greater that the height J1 of embossed indicia 24, and it is also preferred that the height H2 of raised edge 20 be greater that the height J2 of embossed indicia 26.

One advantage of raised edge 18 having a height H1 greater than height J1 of embossed indicia 24 is that raised edge 18 can be used as a glue edge. In use, adhesive or glue may be applied to raised edge 18. When glue is used to attach the escutcheon to a surface, no fasteners need be used.

While edges 18 and 20 are shown to extend generally perpendicular to surfaces 12 and 14 (See FIGS. 2 and 8), it is contemplated to be within the scope of the invention that edges 18 and 20 can extend at angles greater or less than 90 degrees.

Figure 9A:
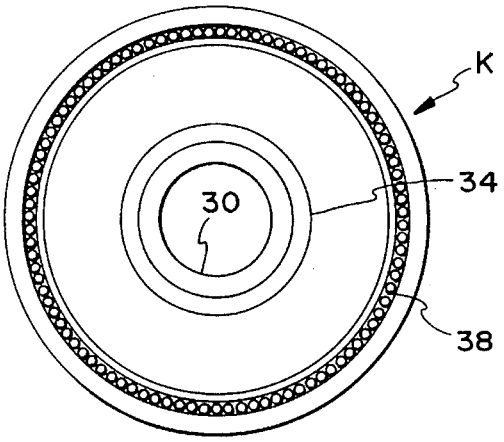
Figure 9B:
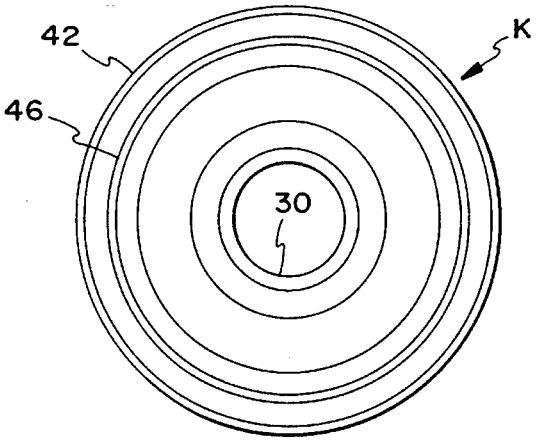

FIGS. 9A and 9B illustrate first and second faces, respectively, of a further embodiment of an escutcheon K according to the invention. As in the other preferred embodiments, FIG. 9A can be referred to as the "front" and FIG. 9B can be referred to as the "rear" it being appreciated that one or both faces will be displayed according to the user. As with the other preferred embodiments of the invention, escutcheon K will typically be glued or otherwise attached to a wall or ceiling, in which case one side would be visible, when installed. When escutcheon K is glued to a clear surface, such as a sliding glass door or window pane, both sides would be visible.

Escutcheon K includes a hole 30 configured to surround the support of a ceiling fixture, for example, and one or more raised portions which have decorative as well as functional uses. For example, portions 34 and 38 are configured to function as elements, conveniently referred to as glue edges, on which an adhesive will be placed for securing the front face of FIG. 9A to a wall. The front face is attached to a wall when the rear face shown in FIG. 9B is to be displayed. It will be appreciated that the extent, configuration, and texture of glue edge 38, for example, will be sized and selected as a function of the size and weight of escutcheon K, the intended use thereof, the surface to which escutcheon K is to be attached, the adhesive to be used, and the like.

The rear face shown in FIG. 9B illustrates additional glue edges 42 and 46, one or both of which may be used when installing escutcheon K on a ceiling, when the front face shown in FIG. 9A is to be visible.

Figure 10A:
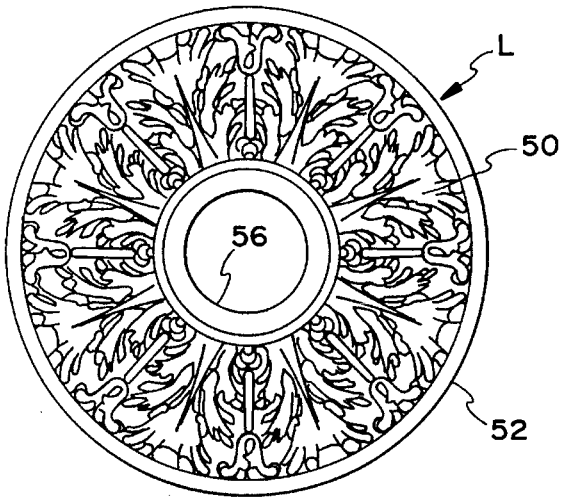
Figure 10B:
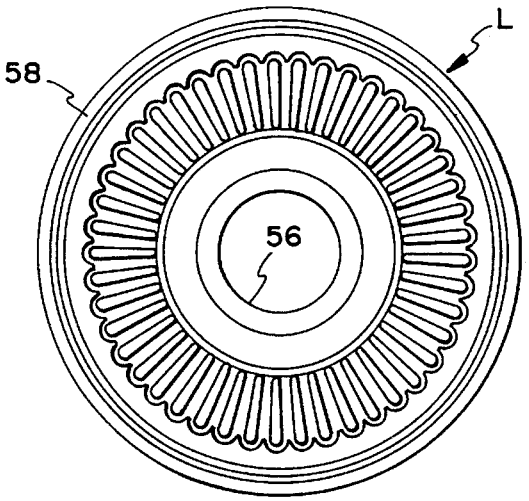

FIGS. 10A and 10B illustrate the front and rear faces, respectively, of an escutcheon L according to another preferred embodiment of the invention. Indicia 50 is surrounded by a raised portion 52, which may likewise serve as a glue edge as in the other embodiments. A hole 56 is provided when an object such as the support for a chandelier is to be surrounded by escutcheon L. The rear side shown in FIG. 10B will have one or more glue edges 58. Hole 56 will be either pre-formed or pre-cut, or will be manufactured so that the user may readily remove a functional and decorative plug, depending on the intended use.

Figure 11A:
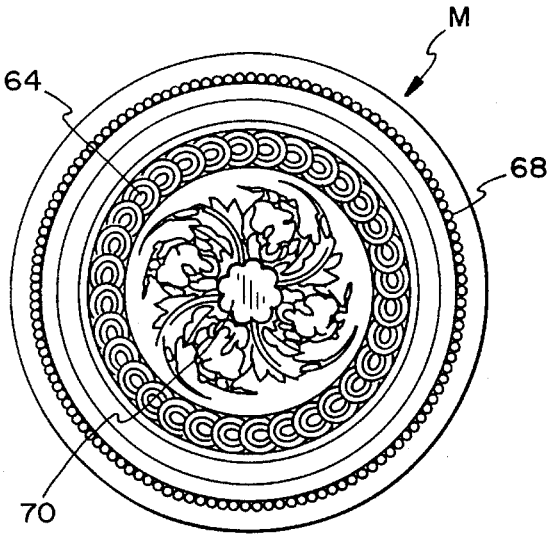
Figure 11B:
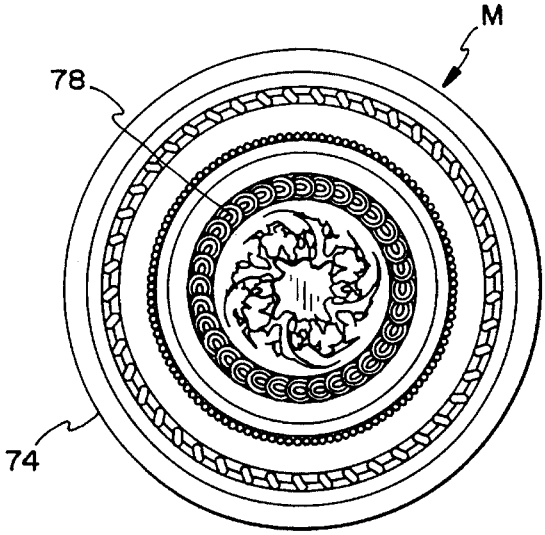

An escutcheon M according to a still further preferred embodiment of the invention is shown in FIGS. 11A and 11B. Escutcheon M has decorative raised portions serving as glue edges 64 and 68, as well as a center 70. In this embodiment the center 70 will typically be formed as a solid portion integral with the remainder of escutcheon M. Escutcheon M is particularly suited for attaching to walls and for applications where nothing extends through the center thereof. The rear face shown in FIG. 11B likewise has glue edges 74 and 78.

It is also contemplated to be within the scope of the invention that each of the embodiments of the escutcheon according to the invention can be secured in place using conventional anchoring devices, such as adhesives, screws, and nails.

While this invention has been described as having a preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

What is claimed is:

1. A one-piece reversible escutcheon for a ceiling fixture, comprising:

a) a base portion having first and second generally opposed surfaces;

b) a first raised edge member extending around at least a portion of the perimeter of said base portion and projecting transversely to said first surface;

c) a second raised edge member extending around at least a portion of the perimeter of said base portion and projecting transversely to said second surface;

d) said first surface and said second surface including indicia of different design;

e) said base portion defining a hole in at least one of said first and second surfaces, said hole being configured for receiving a portion of a ceiling fixture;

f) a first escutcheon face including said first surface extending over at least a portion of the planar area defined within said first raised edge member;

g) a second escutcheon face including said second surface extending over at least a portion of the planar area defined within said second raised edge member and;

h) each one of said first and second edge members being selectively mountable adjacent to a ceiling, wherein when one of said first and second escutcheon faces is substantially exposed, the other one of said first and second escutcheon faces is substantially hidden, during use.

2. A reversible escutcheon for a ceiling fixture as in claim 1, wherein;

a) said hole is a through hole.

3. The device as recited in claim 1, wherein:

a) said first surface includes embossed indicia.

4. The device as recited in claim 1, wherein:

a) said first surface is generally planar.

5. The device as recited in claim 1, wherein:

a) said second surface includes indicia.

6. The device as recited in claim 1, wherein:

a) said second surface includes embossed indicia.

7. The device as recited in claim 1, wherein:

a) said second surface is generally planar.

8. The device as recited in claim 1, wherein:

a) said first raised edge member projects generally perpendicular to said first face.

9. The device as recited in claim 1, wherein:

a) said first raised edge member projects beyond a maximum height of said first surface.

10. The device as recited in claim 1, wherein:

a) said second raised edge member projects generally perpendicular to said second face.

11. The device as recited in claim 1, wherein:

a) said second raised edge member projects beyond a maximum height of said second surface.

12. The device as recited in claim 1, wherein:

a) said base portion is generally circular in shape.

13. The device as recited in claim 1, wherein:

a) said base portion is a polygonal shape.

14. The device as recited in claim 1, wherein:

a) said base portion is made of plastic.

15. The device as recited in claim 1, wherein:

a) said base portion is made of metal.

* * * * *